US006027083A

United States Patent [19]

Chang

[11] Patent Number: 6,027,083

[45] Date of Patent: Feb. 22, 2000

[54] PORTABLE PLANT-BASKET

[76] Inventor: Ling Ming Chang, 174-3 Kuan Chi Rd, Shenkang, Taichung Hsien, Taiwan

[21] Appl. No.: 09/232,660

[22] Filed: Jan. 19, 1999

[51] Int. Cl.[7] ..... A47G 23/02

[52] U.S. Cl. ..... 248/153; 248/302; 47/39; 47/67; 47/41.01

[58] Field of Search ..... 248/302, 303, 248/304, 311.2, 153; 211/85.31, 85.23, 118.1, 88.01, 106; 47/31, 67, 71, 41.01, 41.11, 39, 41.12; D6/556, 513

[56] References Cited

U.S. PATENT DOCUMENTS

| | | | |
|---|---|---|---|
| 2,235,986 | 3/1941 | Ellingson | 248/153 |
| 2,732,954 | 1/1956 | Janonis | 211/88.03 |
| 3,489,385 | 1/1970 | Dill, Jr. | 248/311.2 |
| 3,664,622 | 5/1972 | Vaccaro | 211/88.01 |
| 4,290,529 | 9/1981 | Jones | 211/13 |
| 4,854,227 | 8/1989 | Koopman | 99/416 |
| 4,903,923 | 2/1990 | Krentel | 248/153 |
| 5,711,502 | 1/1998 | Emalfarb et al. | 248/302 |

*Primary Examiner*—Leslie A. Braun
*Assistant Examiner*—Gwendolyn Baxter
*Attorney, Agent, or Firm*—Bacon & Thomas, PLLC

[57] ABSTRACT

The object of the present invention discloses a portable plant-basket which can be disassembled and exchangeable in appearance for various occasions. The portable plant-basket comprises a body, a basket and optionally a base. The body is connected with the basket by several hooks thereof and further fastened by screws and nuts. The body is exchangeable by different appearances according to various occasions. Underneath the basket there is a staple fastener which is fitted on the horizontal part of the L-shape plate on the base. The staple fastener and the L-shape plate are fastened by a screw and a nut. Therefore, the portable plant-basket of the present invention can be combined and disassembled easily. Alternatively, the portable plant-basket can be used as a hanger without connecting with the base.

4 Claims, 5 Drawing Sheets

PORTABLE PLANT-BASKET

BACKGROUND OF THE INVENTION

Plant-decoration for various events is a blooming business around the world. Also, landscaping and planting are commonly used to adorn the life environment whether in a house or in a city planning. However, most of the conventional pots and fixed frames for plants are inflexible. Furthermore, moving the plant-pots one by one from the ground is tiresome, and the conventional fixed frames for plants are space wasting for storing or transporting.

Therefore, there is a need to develop a container having the characteristics of easy moving and can be disassembled while not in use. The present invention thus provides a structure for loading the potted plants with multi-advantages such as exchangeable appearance, easy moving, disassembling, and easy combining etc.

SUMMARY OF THE INVENTION

The object of the present invention discloses a portable plant-basket which can be disassembled and exchangeable in appearance for various occasions. The portable plant-basket comprises a body, a basket and optionally a base. The body is connected with the basket by several hooks thereof and further fastened by screws and nuts. The body is exchangeable by different appearances according to various occasions. Underneath the basket there is a staple fastener which is fitted on the horizontal part of the L-shape plate on the base. The staple fastener and the L-shape plate are fastened by a screw and a nut. Therefore, the portable plant-basket of the present invention can be combined and disassembled easily. Alternatively, the portable plant-basket can be used as a hanger without connecting with the base.

BRIEF DESCRIPTION OF THE DRAWING

FIG. 1A is an enlarged elevation view of the fastened staple fastener and the horizontal part of the L-shape plate on the basket and base, respectively.

DETAILED DESCRIPTION OF THE PREFERRED EMBODIMENT

Figure 1:
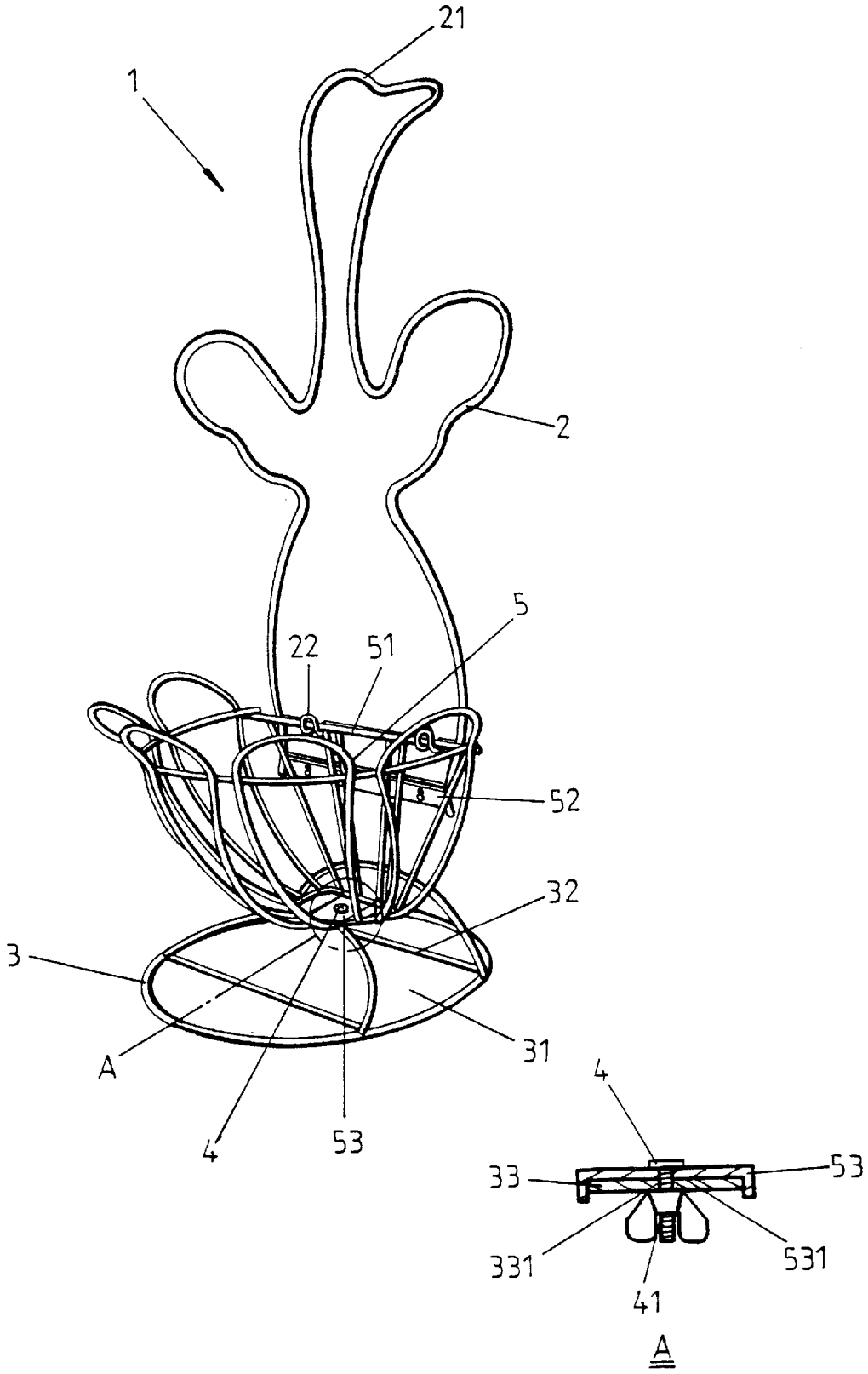
FIG. 1 is an elevation view of the present invention.

Referring to FIG. 1, a portable plant-basket (1) is composed of a body (2), a basket (5), and a base (3). The body (2) can be designed in different appearances and exchangeable according to various occasions. On the top of the body (2), a handgrip (21) is designed for carrying the plant-basket.

Figure 2:
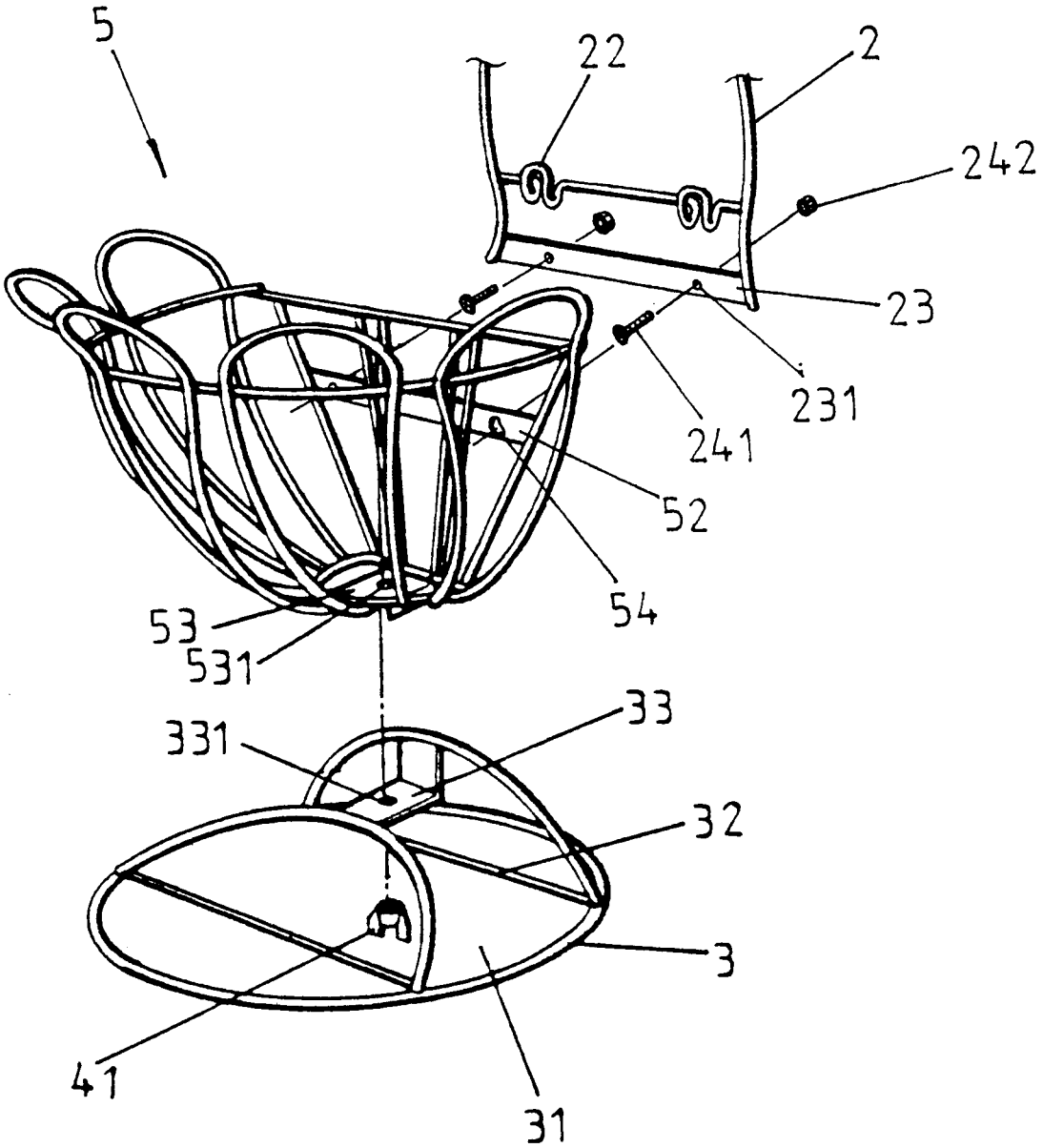
FIG. 2 is an elevation view of the present invention in which the portable Plant-basket of the present invention is divided into three parts.

Referring to FIG. 2, there are two hooks (22) and a strip (23) with pilot holes (231) on the body (2). On the posterior side of the basket (5) there is a strip (52) with pilot holes (54) in the positions corresponding with that for the pilot holes (231) on the body (2). Underneath the basket (5) there is a staple fastener (53) with a pilot hole (531). The body (2) and basket (5) can be combined easily by hooking the posterior side of the basket (5) to the hooks (22), connecting two strips (23) and (52), and then fastening them by screws (241) and nuts (242). The combined body (2) and basket (5) can be used as a portable plant-basket hanger.

Optionally, the portable plant-basket can be used as a stand by further combining an additional base (3). The two ends of an L-shape plate (33) connect two protrusive bars of the base (3), and a pilot hole (331) is on the horizontal part of the L-shape plate (33). The staple fastener (53) on the basket (5) is fitted on the horizontal part of the L-shape plate (33) on the base (3), and they are fastened by a screw (4) and a nut (41).

There are two bars (32) on the bottom of the base (3), and a space (31) is created between the bars (32) and the two protrusive bars. A basin (7) can be put over the bars (32) to receive the water from the plant pots.

Figure 3:
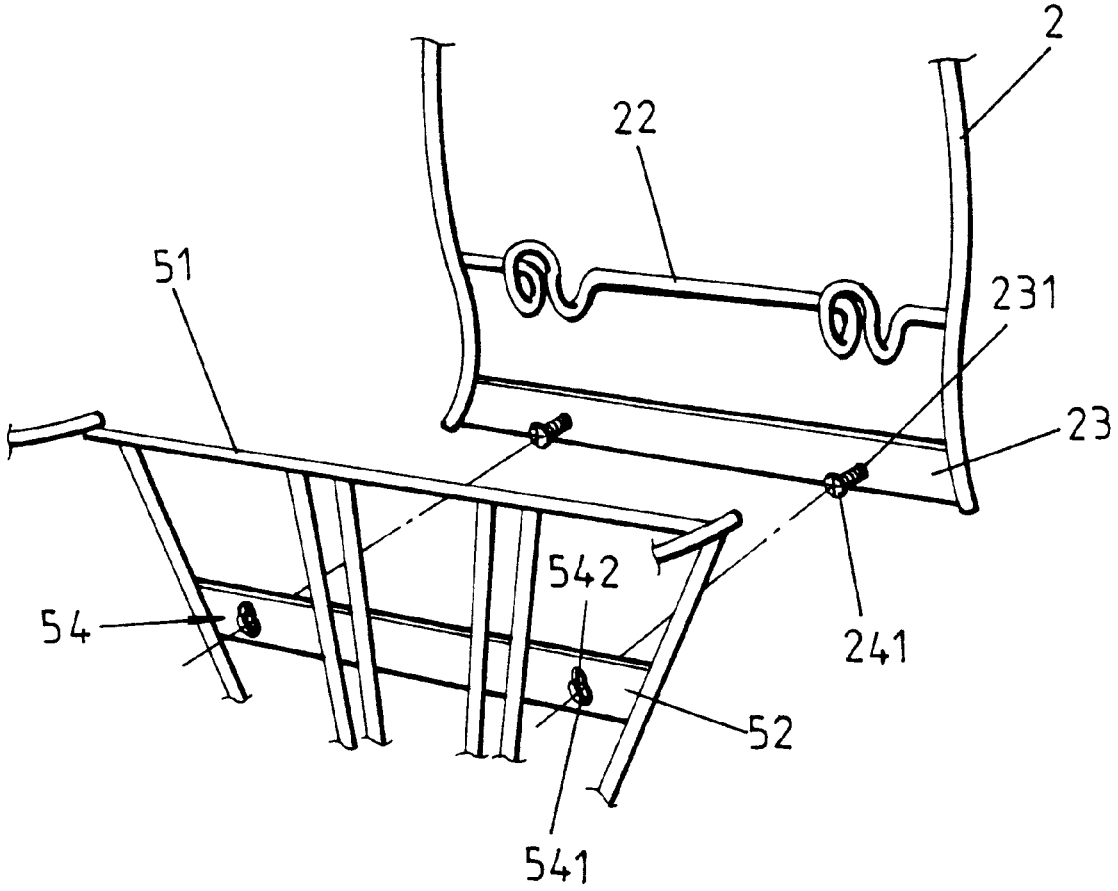
FIGS. 3A, 3B and 3C are elevation view in part of combination of the body and basket.
Figure 3:
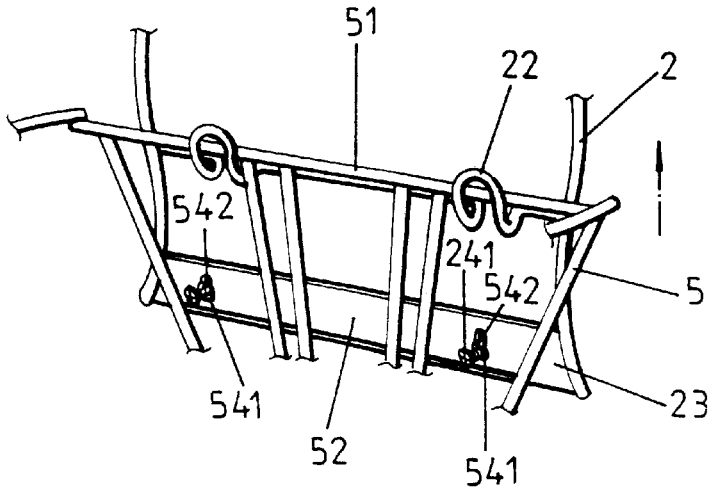
Figure 3:
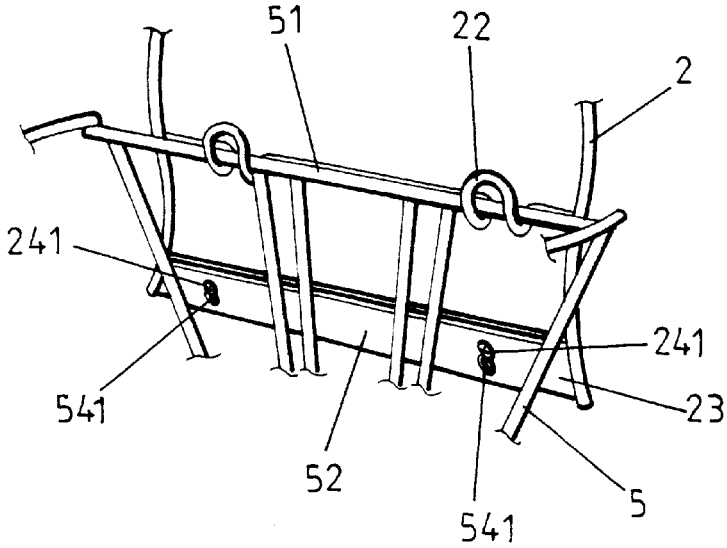
Figure 4:
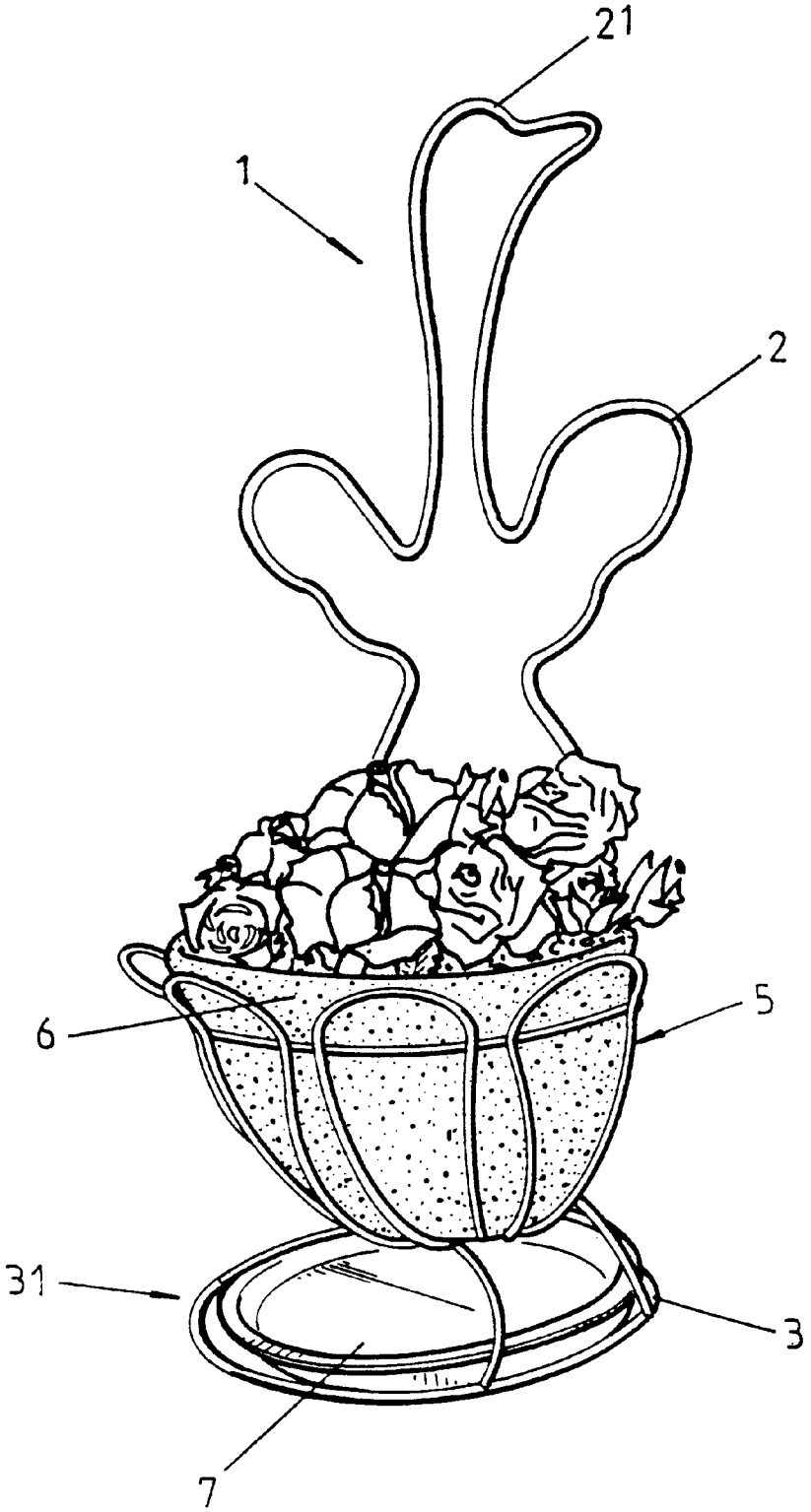
FIG. 4 is an embodiment of the present invention in which a plant is loaded therein.

Referring to FIGS. 3A, 3B, and 3C, the body (2) and the basket (5) are fastened by hooking a rim (51), on the posterior side of the basket (5), to two hooks (22) on the body (2), and two screws (241) and nuts (242) are inserted though the pilot holes on strips (23) and (52).

The pilot hole (54) on the strip (52) of basket (5) can be designed as an unsymmetrical shape with an upper smaller arch (542) and a lower bigger arch (541). The span of the upper arch (542) is smaller than the diameter of the head of the screw (241) but bigger than the diameter of the screw's shank. The span of the lower arch (541) is bigger than the diameter of the head of the screw (241). Therefore, the screw (241) can be set on the pilot hole (231) of strip (23) on the body (2) and fixed loosely with nut (242) prior to connecting the body (2) and the basket (5). When connecting the basket (5) to the body (2), the lower arch (541) is passed through the head of screw (241) and then the shank of screw (241) can be fixed on the upper arch (542). The screw (241) and nut (242) are further fastened to complete the combination. The body (2) can be exchanged by following the combination procedures reversibly whenever it is necessary.

Although the present invention has been explained in relation to its preferred embodiment, it is to be understood that many other possible modifications and variations can be made without departing from the spirit and scope of the invention hereinafter claimed.

What is claimed is:

1. A portable plant-basket comprising:

a body constitutes from a handgrip, several hooks, and a strip with pilot holes; and a basket constitutes from a strip with pilot holes, and a staple fastener with a pilot hole;

wherein positions of pilot holes of the strips on the basket and body are corresponded with each other, and the body and basket can be combined by hooking the posterior side of the basket to the hooks, connecting two strips, and then fasten them with screws and nuts.

2. The portable plant-basket of claim 1, wherein further comprising a base constituted from a L-shape plate with a pilot hole, two protrusive bars connecting with the two ends of the L-shape plate, and two bars on the bottom; the base and basket can be combined by fitting the staple fastener underneath the basket on the horizontal part of the L-shape plate and they are fastened by a screw and a nut.

3. The portable plant-basket of claim 2, wherein a space is created between the bars on the bottom of the base and the two protrusive bars and a basin can be put therein.

4. The portable plant-basket of claim 1, wherein the pilot hole of the strip on the basket is an unsymmetrical shape with an upper smaller arch and a lower bigger arch; the span of the upper arch is smaller than the diameter of the head of the screw used for fasten the basket and body but bigger than the diameter of the screw's shank and the span of the lower arch is bigger than the diameter of the head of said screw.

* * * * *